US007131746B2

(12) United States Patent
Cook

(10) Patent No.: US 7,131,746 B2
(45) Date of Patent: Nov. 7, 2006

(54) LIGHT

(76) Inventor: Bernard Cook, Windsor House, 35 Windsor Street, Cheltenham, Gloucestershire (GB) GL52 2DG ( * ) Notice: Subject to any disclaimer, the term of this patent is extended or adjusted under 35 U.S.C. 154(b) by 134 days.

(21) Appl. No.: 10/919,345

(22) Filed: Aug. 17, 2004

(65) Prior Publication Data

US 2005/0041415 A1 Feb. 24, 2005

(30) Foreign Application Priority Data

Aug. 20, 2003 (GB) ..... 0319484.2

(51) Int. Cl.
*F21V 33/00* (2006.01)

(52) U.S. Cl. ..... 362/133; 362/127; 362/132

(58) Field of Classification Search ..... 362/127, 362/29, 133, 800, 132, 253, 234
See application file for complete search history.

(56) References Cited

U.S. PATENT DOCUMENTS 4,758,585 A * 7/1988 Butler et al. ..... 514/412
4,799,133 A * 1/1989 Strzalko et al. ..... 362/133
5,359,503 A * 10/1994 Myodo et al. ..... 362/127
5,915,824 A * 6/1999 Straat ..... 362/133
6,231,205 B1 * 5/2001 Slesinger et al. ..... 362/133
2003/0062809 A1 4/2003 Koo

FOREIGN PATENT DOCUMENTS

| | | |
|---|---|---|
| DE | 202 13 425 | 12/2002 |
| EP | 1 035 369 | 9/2000 |
| EP | 1 222 885 | 7/2002 |
| JP | 2001-112655 | 4/2001 |
| JP | 2001 155523 | 6/2001 |
| JP | 2003-153755 | 5/2003 |

* cited by examiner

*Primary Examiner*—Thomas M. Sember
(74) *Attorney, Agent, or Firm*—Young & Thompson

(57) ABSTRACT

The shelf light is for fitting in a shelf of an article of furniture. It comprises a two part body and a light emitting diode assembly housed within the body. The part of the body has an integral cover plate which in use lies against one major surface of the shelf and the other part comprises a flange which is arranged in a plane parallel to, but spaced from, the plane of the cover plate and which in use lies against the other major surface of the shelf.

10 Claims, 1 Drawing Sheet

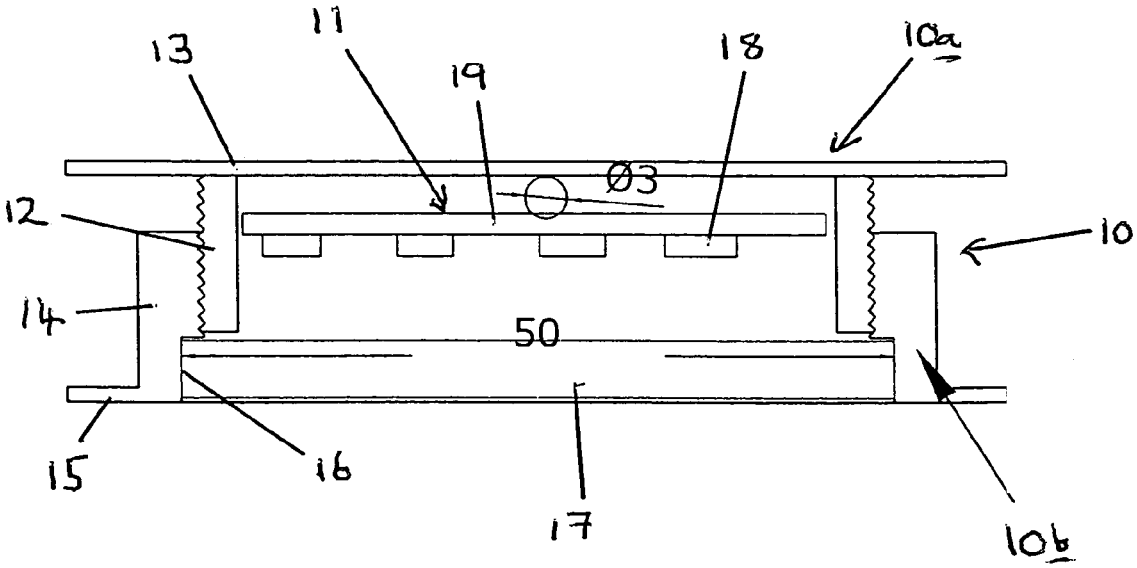
11
13
19
18
10a
Ø3
12
10
14
50
15
16
17
10b

LIGHT

INTRODUCTION

This invention relates to a light and more particularly to a shelf light for fitting in a shelf of an article of furniture.

It is known to provide lights in display stands and cabinets. However, these known lights usually project down from the upper inner surface of the cabinet or are concealed behind a depending lip or bead. There has long been a need for a light that will fit within the thickness of a traditional shelf of furniture but no such lights are currently available.

SUMMARY OF THE INVENTION

According to the present invention there is provided a light for fitting in a shelf of an article of furniture, comprising a two part body and a light emitting diode assembly housed within the body, one part of the body having an integral cover plate which in use lies against one major surface of the shelf and the other part comprising a flange which is arranged in a plane parallel to, but spaced from, the plane of the cover plate and which in use lies against the other major surface of the shelf.

Preferably, the body has a depth not exceeding 40 mm and more preferably, a depth of not exceeding 25 mm.

Advantageously, the body parts have respective hub portions which are of circular cross-section and which are releasably connected together. In this case, the hub portions typically have interengageable screw threads for threaded engagement with one another.

The other part may support a transparent or translucent cover through which light from the light emitting diode assembly is transmitted.

Preferably, the cover plate and flange define opposite extremities of the depth of light.

Preferably, the light emitting diode assembly comprises a plurality of light emitting diodes mounted on a board. In this case the board is typically a printed circuit board.

The invention will now be more particularly described, by way of example, with reference to the accompanying drawing.

BRIEF DESCRIPTION OF THE DRAWING

The drawing is a schematic sectional view of one embodiment of a light according to the present invention.

DESCRIPTION OF THE PREFERRED EMBODIMENT

Referring to the drawing, the shelf light shown therein is designed to fit into a shelf of an article of furniture such as a display stand or cabinet and has a depth substantially equal to the thickness of a shelf. Typically, this is either 15 mm or 18 mm, but could be up to 25 mm or in some cases 40 mm.

The light comprises a two part body 10 and a light emitting diode assembly 11 housed within the body 10. One part 10*a* of the body 10 has an externally screw threaded hub portion 12 and an integral cover plate 13. The hub portion 12 is of circular cross section. The cover plate 13 overhangs the hub portion 12 around the entire periphery of the hub portion 12 and is typically, but not necessarily, circular when viewed in plan.

The other part 10*b* of the body 10 has an internally screw threaded hub portion 14 for screw threaded engagement with the hub portion 12 of the part 10*a*, a peripheral outwardly extending flange 15 and a recess 16 at its lower most end for receiving a transparent or translucent cover or lens 17. The hub portion 14 is of circular cross section and the flange is typically circular when viewed in plan.

The light emitting diode assembly 11 comprises a plurality of light emitting diodes 18 (e.g. six) mounted on a board 19, typically in the form of a printed circuit board. Appropriate resistors (not shown) are also connected to the board. The resistance values of the resistors are chosen so that the light emitting diodes 18 run at only about 90% capacity thereby ensuring a life for the diodes in the order of 100,000 hours.

The light is energised by a remote transformer connected to the light by a wire (not shown) extending through the side of the hub portion 12.

The light has a depth not exceeding 40 mm. The light is preferably formed of metal for aesthetic reasons and typically of brass or nickel plate. The diameter of the hub portion 12 is arranged so that it will fit within a hole created using a standard drill size.

Lights for different shelf thicknesses could have a common body part 10*a* with parts 10*b* of different depth.

In order to assemble the light in the hole, the body part 10*a* is inserted from one end of the hole and the body part 10*b* is then screwed over the body part 10. When fully assembled, the cover plate 13 lies against one major surface of the shelf and the flange 15 of the other part 10*b* lies against the other major surface of the shelf.

The light can be used as an up or down light and can be assembled in any type of shelf including a glass shelf. In order to accommodate the wire, a channel can be formed in one surface of the shelf and, in the case of wooden shelves, this channel can be covered with veneer or filled with any suitable wood filler.

What is claimed is:

1. A shelf light for fitting in a shelf of an article of furniture, comprising a two part body, a light emitting diode assembly housed within the body, and means for clamping the light in the shelf, one part of the body having a first hub portion and an integral cover plate forming part of the clamping means by lying against one major surface of the shelf, and the other part of the body comprising a second hub portion with a peripheral flange that extends outwardly from one end of the second hub portion and which is arranged in a plane parallel to, but spaced from, the plane of the cover plate and forming another part of the clamping means by lying against the other major surface of the shelf, wherein a plane of the cover plate and a plane of the flange define opposite longitudinal extremities of the light.

2. A shelf light as claimed in claim 1, wherein a distance between the plane of the cover plate and the plane of the flange does not exceed 40 mm.

3. A shelf light as claimed in claim 2, wherein the distance does not exceed 25 mm.

4. A shelf light as claimed in claim 1, wherein said first and second hub portions are of circular crosssection and are releasably connected together.

5. A shelf light as claimed in claim 4, wherein the hub portions have interengageable screw threads.

6. A shelf light as claimed in claim 1, wherein the other part of the body supports a transparent or translucent cover through which light from the light emitting diode assembly is transmitted.

7. A shelf light as claimed in claim 1, wherein the light emitting diode assembly comprises a plurality of light emitting diodes mounted on a board.

8. A shelf light as claimed in claim 7, wherein the board is a printed circuit board.

9. An article of furniture comprising in combination a shelf and a shelf light:

the shelf comprising opposing major surfaces; and the shelf light comprising a two part body and a light emitting diode assembly housed within the body, one part of the body having an integral cover plate lying against one of the major surfaces of the shelf, and the other part comprising a flange which is arranged in a plane parallel to, but spaced from, the plane of the cover plate and lying against the other of the major surfaces of the shelf, wherein a plane of the cover plate and a plane of the flange define opposite longitudinal extremities of the light, and wherein the cover plate and flange clamp the shelf light to the shelf.

10. A shelf light comprising:

a first part with a radially extended first flange at a first longitudinal end of the light and a longitudinally extended first hub;

a second part with a radially extended second flange at a second longitudinal end of the light opposite the first end and a longitudinally extended second hub, said first and second hubs being releasably joined to each other, said first and second flanges defining opposite distal surfaces of the light and being spaced from each other by a distance corresponding to a longitudinal extent of said first and second hubs joined to each other;

a light emitting diode assembly in one of said first and second parts; and a light transmissive member in one of said first and second parts.

* * * * *